United States Patent [19]

Michalson

[11] 4,063,738

[45] Dec. 20, 1977

[54] GOLF COURSES

[76] Inventor: George M. Michalson, 23198 Cedar Point Road, Brook Park, Ohio 44142

[21] Appl. No.: 620,372

[22] Filed: Oct. 7, 1975

[51] Int. Cl.[2] ..... A63B 69/36

[52] U.S. Cl. ..... 273/176 A; 273/181 E; 273/176 L

[58] Field of Search ..... 273/176 A, 176 R, 176 AA, 273/176 AB, 176 F, 176 FA, 176 FB, 176 L, 181 E

[56] References Cited

U.S. PATENT DOCUMENTS

| | | | |
|---|---|---|---|
| 2,003,074 | 5/1935 | Gage | 273/176 A |
| 2,577,690 | 12/1951 | Reach | 273/176 A |
| 3,464,703 | 9/1969 | Vallas | 273/176 A |
| 3,695,619 | 10/1972 | Brobston | 273/176 A |
| 3,897,947 | 8/1975 | Heffley | 273/176 A |
| 3,904,209 | 9/1975 | Thomas | 273/176 A |

*Primary Examiner*—George J. Marlo
*Attorney, Agent, or Firm*—Watts, Hoffman, Fisher & Heinke Co.

[57] ABSTRACT

A compact golf course is disclosed which, in one embodiment, simulates a conventional nine hole golf course. By playing on this compact course a golfer can approximate all of the swings that he personally would have required in order to play nine holes of golf on a conventional course. Yet, that player need only walk the length of one conventional fairway.

The compact golf course comprises a single common elongate fairway and a single common target green at one end of the fairway. A plurality of hitting positions are disposed radially with respect to the target green and are spaced peripherally along one side of the length of the fairway as well as along the end of the fairway opposite to the end where the target green is located. A common putting green is disposed adjacent the fairway near the hitting position located closest to the target green. The fairway is divided into zones by arcuately extending ribbon switches which are responsive to a golf ball passing thereover and generate a visual signal at the hitting positions.

10 Claims, 3 Drawing Figures

GOLF COURSES

SUMMARY

This invention relates to the improvement of the game of golf by allowing the game to be played on an area of approximately one-tenth the size of a golf course and to the improvement and usefulness of golf driving ranges. The object of the game and the equipment used to play the game are the same as a regular game of golf. The sequence of play is the only difference because of the games adaption to the smaller playing area. The primary object of the game is to provide facilities for playing golf at a fraction of the cost for land, construction, and maintenance. These gains are realized because of designed departures from ordinary golf courses, which can accomodate land the size and shape of a golf driving range.

Another object of the game is to provide a technique for playing golf where more time is spent playing golf, less time is spent walking, poor golfers do not hold-up good golfers, golf balls are not lost, and the end result is a round of golf in less time. All these advantages are provided by this design because the players never enter upon the fairway and the maximum distance walked is the length of the field or approximately 500 yards.

Still another object of this invention is to make night golf possible and TV golf matches possible over a course with championship yardage. The smaller playing area makes this economically feasible.

Another object of this game is to provide golf driving ranges with a game so similar to golf that players will compete the same as golf, for the same typical score, over the same equivalent yardage and with the same golfing equipment.

LIST OF DRAWINGS

DESCRIPTION AND METHOD OF PLAY

The objective of this invention and the equipment necesary to play the game are the same as a regular game of golf. Each player has a goal to try and shoot par on a layout with yardage equivalent to a typical golf course. The invention is different from regular golf because it uses only one fairway for nine holes and can be accomodated by the playing areas of most driving ranges.

Figure 1:
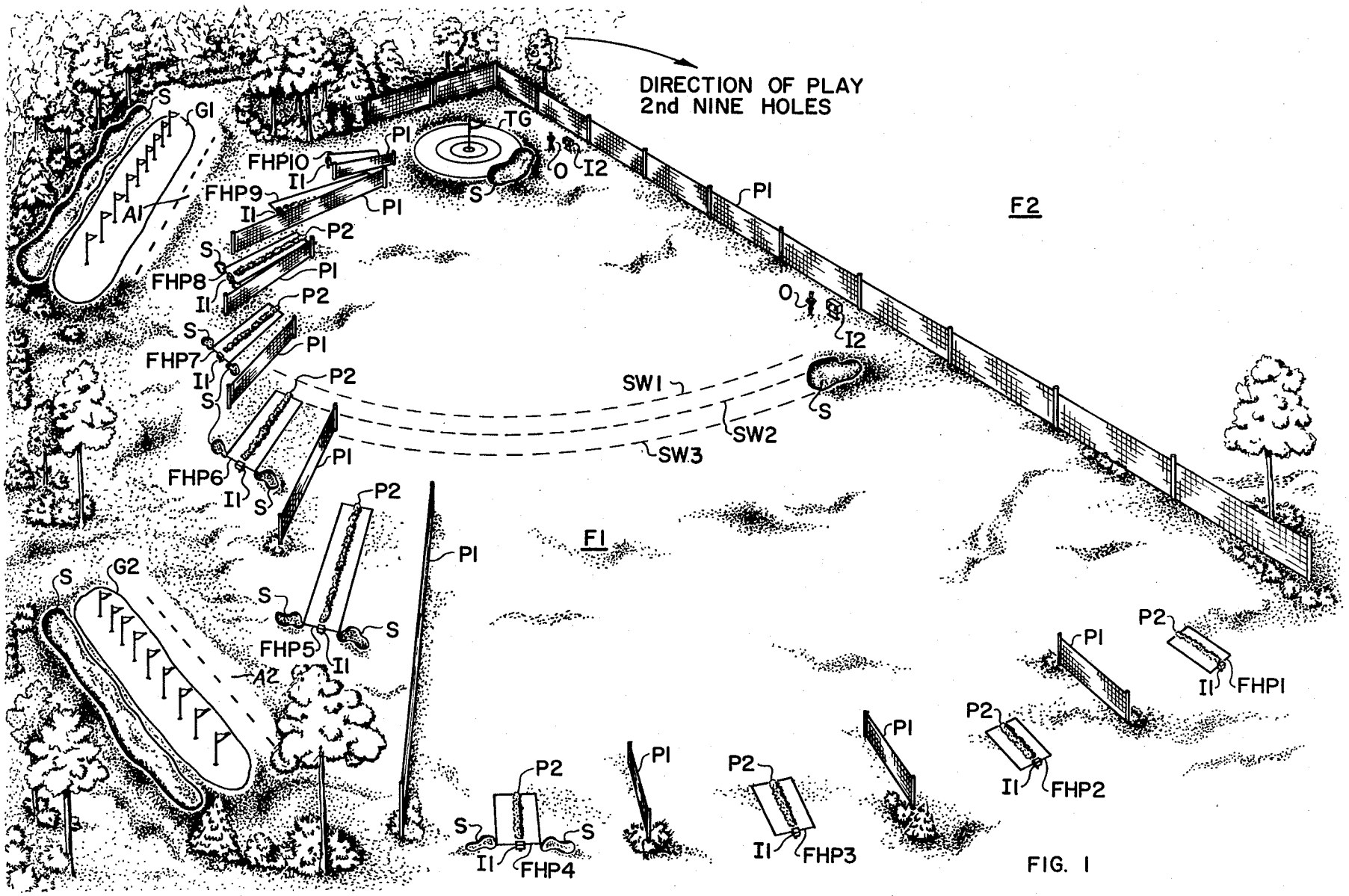
FIG. 1 is a perspective view of the golf playing area.

The course layout is shown in FIG. 1. This layout is comprised of a Target Green (TG), two Putting Greens (G1 and G2), ten Fairway Hitting Positions (FHP1 thru FHP10), two Fairways (F1 and F2), protective Screens (P1 and P2), Indicators (I), Observers (O), and Standtraps (S). F2, S, G2 and O are considered optional and are only discussed briefly in the description that follows. The area shown in FIG. 1 covers approximately 7.5 acres of land and is approximately the size and shape of a driving range. This area can accomodate nine holes of golf play. The area F2, opposite the protective fence P1 is used for normal driving range operation or can be a second nine holes. If a second nine holes is constructed the direction of play would be in the opposite direction from the original (first) nine as shown in FIG. 1.

Figure 2:
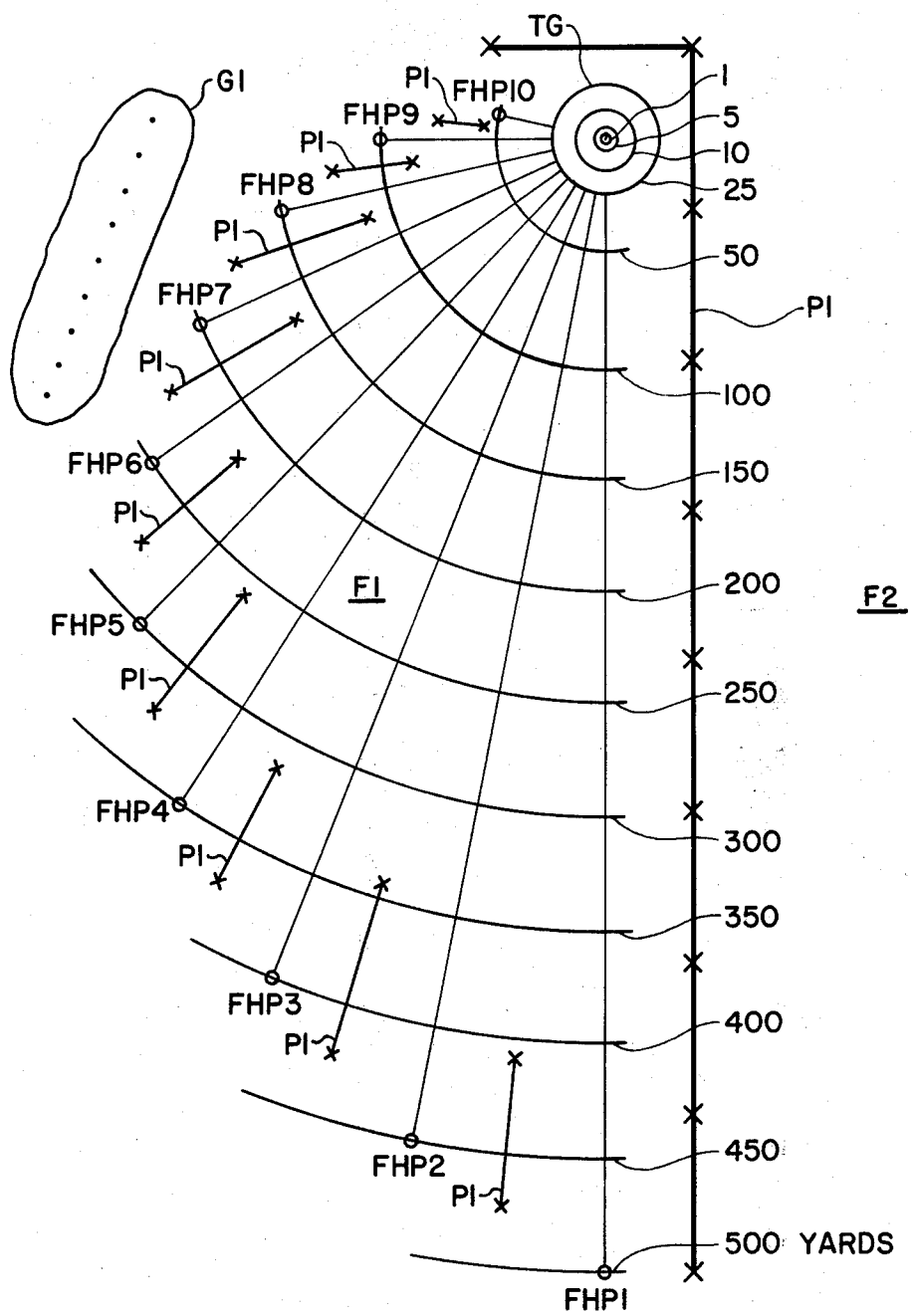
FIG. 2 shows the golf course with a distance of 500 yards from Fairway Hitting Position 1 (FHP1) to the Target Green (TG).

If the golf course is constructed on land that is deep enough to accomodate a distance from FHP1 to the target green (TG) of 500 yards, it would look like FIG. 2. Most golf driving ranges are not this deep and the course would be set-up as shown in FIG. 1. In FIG. 1, the first four Fairway Hitting Positions (FPH1 thru FPH4) are the same distance to the Target Green (TG), 350 yards.

The score card contains all the information necessary to understand and play the game. A typical score card is shown as follows:

| | | | FAIRWAY HITTING POSITION | | | | | | | | | | PUTTING GREEN | | | | HOLE |
|---|---|---|---|---|---|---|---|---|---|---|---|---|---|---|---|---|---|
| | | | 1 | 2 | 3 | 4 | 5 | 6 | 7 | 8 | 9 | 10 | | | | | |
| HOLE | PAR | YARDS | 500 | 450 | 400 | 350 | 300 | 250 | 200 | 150 | 100 | 50 | 25 | 10 | 5 | 1 | TOTAL |
| 1 | 5 | 500 | | | | | | | | | | | | | | | |
| 2 | 5 | 500 | | | | | | | | | | | | | | | |
| 3 | 4 | 450 | | | | | | | | | | | | | | | |
| 4 | 4 | 400 | | | | | | | | | | | | | | | |
| 5 | 4 | 400 | | | | | | | | | | | | | | | |
| 6 | 4 | 350 | | | | | | | | | | | | | | | |
| 7 | 4 | 350 | | | | | | | | | | | | | | | |
| 8 | 3 | 200 | | | | | | | | | | | | | | | |
| 9 | 3 | 150 | | | | | | | | | | | | | | | |
| IN | 36 | 3300 | | | | | | | | | | | NINE HOLE TOTAL | | | | |

This score card represents a par 36 course with a yardage of 3300, ten Fairway Hitting Positions and four distances from the hole at the Putting Green. It is possible to design the golf couse and score card for any yardage or par with any number of Fairway Hitting Positions or Putting Green positions being used.

Circles on the scorecard represent the position where the first shot for a hole is played, at this position a tee may be used for this shot. Fairway Hitting Positions FHP 1,2,3, 4,7 and 8 are tees for the following holes:

Hole No. 1 — 500 yards — par 5 — tee-off from FHP1

Hole No. 2 — 500 yards — par 5 — tee-off from FHP1

Hole No. 3 — 450 yards — par 4 — tee-off from FHP2

Hole No. 4 — 400 yards — par 4 — tee-off from FHP3

Hole No. 5 — 400 yards — par 4 — tee-off from FHP3

Hole No. 6 — 350 yards — par 4 — tee-off from FHP4

Hole No. 7 — 350 yards — par 4 — tee-off from FHP4

Hole No. 8 — 200 yards — par 3 — tee-off from FHP7

Hole No. 9 — 150 yards — par 3 — tee-off from FHP8

The longest shots are always played first in this game; therefore, they begin at the maximum distance from the Target Green (TG) or Fairway Hitting Position No. 1 (FHP1), which represents the two 500 yard par 5 holes. Because the holes are always played in their proper numerical order, hole No. 1 is played before hole No. 2. The circles on the score card for Fairway Hitting Position FHP1 are played first and always played in sequence from top to bottom. The balls hit from the Fairway Hitting Positions FHP1 thru FHP10 are aimed at a green, Target Green (TG). The ten Fairway Hitting Positions are located along the side of the fairway F1 at 50 yard intervals, see FIG. 2. Instead of playing the ball as it lies on the fairway F1, as regular golf does, follow-up shots for each hole are played from the Fairway Hitting Position, which represents the remaining yardage for that hole. An automatic distance indicator (I) is located at all ten Fairway Hitting positions to aid the golfer in determining where the next shot will be played for the hole. A circle is placed on the scorecard under the Fairway Hitting Position number corresponding to the indication that is given. With the automatic monitoring system it is possible to monitor shots to any distance desired, but accuracies of greater than 10 yards are not recommended. For example if accuracies of 10 yards are used, four additional hitting areas are needed at each Fairway Hitting Position, 10 yards apart. If a golfer hits a shot 240 yards the automatic distance monitoring system will indicate a position 40 yards closer to the Target Green TG at the correct Fairway Hitting Position. The golfer can play the game without the automatic distance monitoring system by visually monitoring his own shots. When this is done, the shot distances are determined by yardage markers on the fairway, every 50 yards. Golf balls are furnished for shots from the ten Fairway Hitting Positions. The balls are hit toward the Target Green (TG) and left on the ground in the Fairway (F1). As optional, the Fairway (F1) would have sand traps (S) located in strategic areas, see FIG. 1. If sand traps are used, they must also be placed at the Fairway Hitting Position that represents the same distance to the Target Green. Upon entering a sand trap with his shot a golfer would indicate on the scorecard for that hole that a sand shot is required. When he reaches the Fairway Hitting Position with the sand shot, he will drop a ball over his shoulder into the trap and play the ball toward the Target Green (TG).

The size of the Fairway Hitting Positions can vary depending upon the overall design of the golf course, whether it uses the Automatic Monitoring System and/or contains sand traps, water holes or other hazards. A depth of at least 50 yards is required if the Automatic Monitoring System is used; otherwise a depth of 30 yards is adequate. The width depends on the built-in hazards used and the aesthetic features required. The more lakes and trees, the more beautiful and challenging the course will be. The recommended width is at least 10 yards. Two separate hitting areas are needed at each Fairway Hitting Position. This is necessary to allow the faster golfers to play around the slower golfers. These hitting areas must be identical as far as size and hazards and be separated by a protective screen (P2) to protect the golfers hitting from the same Fairway Hitting Position. These screens do not have to be as high as (P1), which is used to protect golfers on other Fairway Hitting Positions and to define Fairway (F1). P1 should be at least 20 feet high; whereas, 6 feet can satisfy the heigth of P2 and can be a thick shrub instead of a fence. P1 also support the lights when night golf is desired.

The Target Green (TG) is used only for the target. It has three concentric circles on it; a one (1) yard circle, a five (5) circle, and a ten (10) yard circle with a hole as its center. The apron of the green extends out twenty-five (25) yards from the hole (cup) and also has a circular marker to represent its perimeter. All shots landing on or within 25 yards of the hole at the Target Green (TG) are eventually played at an equivelent distance from the hole at the Putting Green (G1). All putting shots are preformed at the Putting Green. All pitching and chipping to the green are performed on the apron (A1 and A2) adjacent to the putting green. The Putting Green is divided into nine sections, one for each hole. Each section has a 25, 10, 5, and 1 yard marker where the shots are played. For this portion of the game each player uses his own ball and plays the ball from the distance position, corresponding to where the ball was at the Target Green (TG). Holes are played in there proper numerical order and each hole is completed before proceeding to the next hole. The Putting Green (G2) is used as a back-up green for G1.

Figure 3:
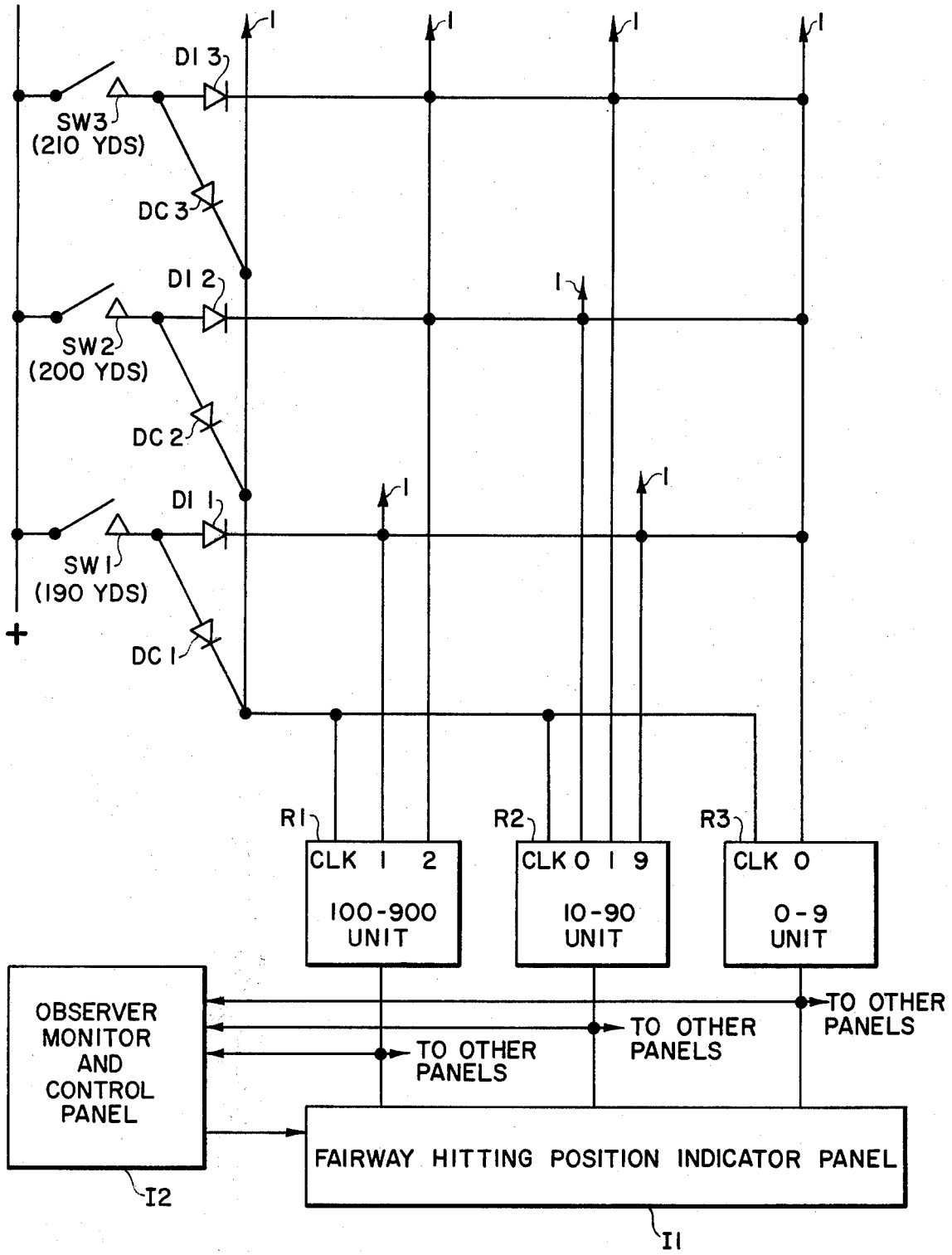
FIG. 3 is an electrical block diagram of the Automatic Monitoring System.

FIG. 3 shows a simplified block diagram of the Automatic Monitoring System. The system when installed with the layout of FIG. 1 can monitor the distance of golf balls hit from 0 to beyond 300 yards to accuracies of 10 yards. To illustrate the system only the circuitry for 190, 200 and 210 yard indications will be covered, all other distances and the circuitry involved are typical. SW1, SW2 and SW3 are ribbon switches that lie across the fairway and work as a continuous momentary contact type switches, that close when a golf ball rolls over them.

The branch connections (1) shown in FIG. 3 go to ribbon switches for other yardages not covered in this discussion. DI1, DI2, and DI3 are isolation diodes that feed voltages to bistable latching circuits R1, R2 and R3 when there respective momentary ribbon switches are energized by a golf ball. R1, R2 and R3 are either electronic solid state or electro-mechanical type circuits that store whatever input date is given to it until another input is provided. R1 is considered a 0–9 (100's) unit and latches values of 1,2 and 3 for 100, 200 and 300 magnitudes. R2 is a 0–9 (10's) unit and latches values of 0 through 9 for 10 through 90 magnitudes. R3 is a 0–9 digit unit and could be omitted for this application because only a 0 input is used. DC1, DC2 and DC3 are isolation diodes required to feed the common latching clock signal required for bistable circuit operation. R1, R2 and R3 feed indicator panels (I1 and I2 of FIG. 1 and 3) which contains the readout device. The readout device can be either a digital display with the actual yardage shown and/or indicator lights to show at what Fairway Hitting Position the next shot for the hole will be played. An observer monitor and control panel (I2) is also connected to the indicator panels (I1). This is located with the observers (0) at the Target Green (TG) and opposite FHP7 by the fence (P1) on FIG. 1. The observers function is to monitor and control activities and to help control the flow of players on the golf course. He has at his disposition a switch that can hold up play at any FHP with a light indication on the indicator panel. If a semi-automatic monitoring system is desired, observers (0) can provide all the distance informatin tothe indicator panels (I1).

Because the automatic monitoring system provides the golfer with an accurate indication of his yardage for his shots, its adaptation for practice when the course is closed, can be readily seen. A driving range that could not afford to install the complete golf course, might be interested in installing the first 4 Fairway Hitting Positions and at least benefit from the monitoring capability. It would provide an invaluable tool for a golf pro giving a lesson or a golfer concerned with how far he is hitting the ball. In a normal installation each FHP would have two hitting areas each with it's own indicator panel; therefore, the arrangement in FIG. 1 would consist of eight hitting areas. The driving range could eventually install the other FHP, one at a time, until finally it included the complete golf course.

The local rules and facilities would govern the overall rules for a golf course; therefore, each course would have somewhat different rules. A typical set of rules for a course without automatic monitoring and with scorecard similar to the example might be:

1. Tee may be used for first shot of each hole.
2. Always play longest shots first; therefore, game starts at par 5, 500 yard hole.
3. Always play holes in their proper numerical order whenever more than one hole has a shot at the same distance.
4. Record a one (1) on the scorecard in the circle if the ball goes beyond the first yardage marker. This yardage marker corresponds to 50 yards at every Fairway Hitting Position except No. 10. At Fairway Hitting Position No 10 the first distance marker corresponds to 25 yards. If the player fails to reach the first marker on his initial shot and fails again on his second attempt, he records a two (2) on the scorecard for that Fairway Hitting Position and plays the next shot for that hole at the next hitting position, which the 25 yard position at the putting green.
5. A player must monitor his own yardage up to 150 yards. The semi-automatic distance indicators monitor all shots 150 and greater or in the Target Green area.
6. Circles are placed on the scorecard to remind the golfer where his next shot will be for that hole. Strokes are recorded in the circles for shots at the hitting position where the shots are played.
7. For all follow-up shots, following the intitial shot for each hole, the ball is dropped over the players shoulder and played as it lies.
8. At the putting green area the player uses his own ball and playes Hole No. 1, first, from the distance marked on the scorecard. Each hole is completed before proceeding to the next one. Strokes are recorded in the circles on the card upon completion of each hole. Holes are played in numerical order.
9. When all holes are completed the total strokes are figured by adding the hole total from left to right, then adding the nine hole total from top to bottom.
10. All normal golf etiquette and rules shall be observed.

Having disclosed my invention, I claim:

1. A compact golf course, comprising:

a. a single, elongate common fairway;

b. a single common target green disposed proximate one end of said fairway;

c. an array of serially arranged hitting positions located radially from said common target green and spaced peripherally of both the length of said fairway along one side thereof and of the end of the fairway opposite the target green, said array comprising, i. a first hitting position disposed proximate the opposite end of the fairway from said target green and being the hitting position farthest removed from said target green, ii. a last hitting position being the hitting position disposed closest to said target green, and iii. a plurality of additional hitting positions being disposed serially of each other along said fairway intermediate said first and last hitting positions, each of said hitting positions being disposed at a pre-determined distance from said common target green, at least some of said pre-determined distances being distinct from others of said pre-determined distances;

d. means dividing said common fairway into a plurality of zones extending arcuately across the fairway, each said zone being generally concentric with said target green and demarcating a pre-determined range of distance from said target green; and e. a common putting green disposed adjacent said fairway.

2. The golf couse of claim 1 wherein said putting green includes nine hols, each said hole having a pre-determined putting position, said putting green also including an apron adjacent to said putting green providing pre-determined pitching and chipping positions.

3. The compact golf course of claim 1 wherein said common putting green is disposed in close proximity to said last hitting position.

4. The golf course of claim 1 wherein said target green is divided into a plurality of visible, concentric target circles.

5. The golf course of claim 1 wherein each of said hitting positions is partitioned into two elongate side by side hitting areas, each hitting area facing onto the common fairway whereby golfers may play from both said areas of any of said hitting positions simultaneously.

6. The golf course of claim 1 wherein an elongate barrier is disposed between each of adjacent ones of said hitting positions, each said elongate barrier being generally oriented radially with respect to said target green.

7. The compact golf course of claim 1 wherein said fairway dividing means comprises sensing means extending continuously across said fairway between each of said zones and being responsive to a golf ball passing thereover to generate a signal, said golf course further comprising means responsive to individual ones of said sensing means to produce a visual display indicative of the signal of a particular one of said sensing means.

8. The compact golf course of claim 7 wherein each said sensing means comprises an electrical ribbon switch which closes when a golf ball rolls over it.

9. The compact golf course of claim 8 wherein a visual indicator is disposed at each said hitting position.

10. The compact golf course of claim 7 wherein said means responsive to each of said sensing means comprises a plurality of registers for recording signal data, a diode steering circuit for steering each said signal to the appropriate one of said registers, and a visual display responsive to said registers for indicating the approximate relative location of golf balls hit into said fairway.

* * * * *

UNITED STATES PATENT AND TRADEMARK OFFICE

CERTIFICATE OF CORRECTION

PATENT NO. : 4,063,738

DATED : December 20, 1977

INVENTOR(S) : George M. Michalson

It is certified that error appears in the above-identified patent and that said Letters Patent are hereby corrected as shown below:

Col. 2, line 4, "protective" should be -- Protective --;

Col. 1 and 2, line 29, Score card "FAIRWAY HITTING POSITION", insert circles -- 0 -- on lines 1, 2, col. 1; line 3, col. 2; lines 4, 5, col. 3; lines 6, 7, col. 4; line 8, col. 7; line 9, col. 8.

Col. 4, line 11, "equivelent" should be -- equivalent --; line 44, "date" should be -- data--; line 68, between "tothe" insert a space -- to the --

Col. 5, line 32, after "No" insert -- . --; line 52, "playes" should be -- plays --;

Col. 6, line 29, "hols" should be -- holes --; line 31, after "apron" insert -- area --.

Signed and Sealed this

Eighteenth Day of April 1978

[SEAL]

Attest:

RUTH C. MASON
Attesting Officer

LUTRELLE F. PARKER
Acting Commissioner of Patents and Trademarks